United States Patent [19]

Wagner

[11] 4,129,908

[45] Dec. 19, 1978

[54] FOUNDATION UNIT WITH CUSHIONED CROSS RAILS

[75] Inventor: Robert F. Wagner, Lombard, Ill.

[73] Assignee: Sealy, Inc., Chicago, Ill.

[21] Appl. No.: 849,170

[22] Filed: Nov. 7, 1977

[51] Int. Cl.[2] ..... A47C 23/04

[52] U.S. Cl. ..... 5/35; 5/247; 5/260

[58] Field of Search ..... 5/239–247, 5/255, 260–262, 345 R, 351

[56] References Cited

U.S. PATENT DOCUMENTS

| | | | |
|---|---|---|---|
| 3,085,259 | 4/1963 | Sandor | 5/247 |
| 3,441,961 | 5/1969 | Poerink | 5/247 |
| 3,546,723 | 12/1970 | Cianipa et al. | 5/247 |
| 3,935,605 | 2/1976 | Hutchinson | 5/351 |
| 3,992,732 | 11/1976 | Cervisi | 5/351 |
| 4,068,329 | 1/1978 | Gross et al. | 5/260 |

*Primary Examiner*—Casmir A. Nunberg
*Attorney, Agent, or Firm*—Roy E. Hofer; Joan I. Norek

[57] ABSTRACT

An improved foundation unit for a mattress or the like is provided which is firmer in the center than conventional torsion spring-type foundation units while having sufficient flexibility under normal loads and weight distribution to comfortably support a body upon an overlying mattress. The foundation unit includes a resilient border which protects the edge of an overlying mattress from damage when subject to extraordinary weight concentration and a center region formed of a plurality of cross rails cushioned at least about their upper surfaces which immediately underlie the upper surface of the unit. The cushioning elements may be thick foam housings that cover at least the upper surface of the cross rails or sinuous wire springs that extend along the length of the cross rails. The cross rails themselves preferably have a limited degree of flexibility so as to better withstand high impact loads.

16 Claims, 10 Drawing Figures

FOUNDATION UNIT WITH CUSHIONED CROSS RAILS

BACKGROUND OF THE INVENTION

This invention relates to an improved foundation unit for supporting a mattress of the like and, more particularly, a foundation unit with a resilient border and a center that is firmer than conventional torsion spring-type units and yet is sufficiently resilient to support a body on an overlying mattress comfortably.

It generally desirable to have a firm surface for sleeping or reclining upon and many improvements have been made in the structure of mattresses to provide such a firm surface. The underlying foundation unit also contributes to the degree of firmness of the mattress sleeping surface, but also must protect the mattress from damage due to ordinary and/or unusual use. Mattresses generally include an innerspring assembly consisting of a plurality of coil springs which can be damaged or crushed under unusual loads, if not provided with an underlying structure that has a sufficient degree of resiliency to absorb such crushing pressures. For instance, if a mattress containing coil springs with four or five convolutions per spring (the most common type of mattress) is supported by a rigid surface or platform, it will suffer an extreme amount of wear because it has no underlying structure to absorb some of the loads to which it is subjected. It is therefore desirable to provide a foundation unit that contributes to the firmness of a mattress sleeping surface and is sufficiently resilient to protect a mattress during normal and extraordinary uses, such as from a person sitting at the edge of the mattress.

Foundation units are generally formed of a wooden, rectangular frame which is transversed by a series of cross rails positioned near the bottom of the unit, which rails support a plurality of torsion springs or the like. The torsion springs are secured at their lower ends to these cross rails while the upper portion of the torsion springs supports the upper surface of the unit. The upper surface of the unit generally includes some insulating material and a decorative covering which is extended down the sides of the unit and secured to the bottom of the frame. The upper surface can also include a wire grid underlying the insulating material, which grid may be secured to the torsion springs below.

Such a foundation unit, which includes torsion springs throughout its structure, does protect a mattress from unnecessary damage but does not contribute to the firmness of the entire assembly to the extent desired. The most important area to which a foundation unit can contribute firmness is the center region upon which a body will most frequently be reclined. It is desirable to provide a foundation unit which will contribute firmness to the overlying mattress sufficient to support a reclining body with its spine in a straight position and this requires that the assembly be sufficiently resilient to conform to the body's shape and yet not allow portions of the body to sag.

Apparatus for supporting mattresses which are simply frames with cross slats or the like are known in the art, for example as disclosed in U.S. Pat. No. 2,638,606. It is also known in the art to cushion such slats with devices such as an overlying foam pad as disclosed in U.S. Pat. No. 3,554,745. Such supporting devices, however, do not provide firm center support while maintaining sufficient flexibility for comfort. It is also known from U.S. Pat. Nos. 3,935,605 and 4,012,802 that a foundation unit can have a rigid center portion and a peripheral resilient area wherein the center region is substantially unyielding under normal loads. These foundation units would be too rigid to provide a comfortable degree of flexibility and damage-preventing support for the average innerspring assembly of a mattress.

It is desirable to provide a foundation unit for a mattress or the like which is firmer than a torsion spring unit about the center region while being sufficiently flexible to reduced damage to the overlying mattress and allow a comfortable degree of resiliency. It is also desirable to provide a foundation unit which includes a border region of greater resiliency than the center region to reduce damage from crushing loads to the overlying mattress due to the extraordinary use often encountered about the border region from common practices such as sitting on the edge of the assembly. It is also desirable to provide a foundation unit which has a secondary flexing mechanism to protect an overlying mattress by absorbing in part extraordinary loads or impacts. It is also desirable to provide a foundation unit assembly wherein a degree of firmness about the center region can be varied as desired by simple alterations of one or more variables in the construction without changing the design of the unit or method of assembly.

It is therefore an object of the invention to provide a foundation unit with a center region firmer than conventional torsion spring units while maintaining the degree of resiliency provided by torsion springs along the border or edge areas where the overlying mattress receives more frequent heavy loads which could crush the mattress edge if the underlying foundation was not resilient. It is also an object to provide a unit with a sufficient degree of resiliency about the center region to support a reclining body on an overlying mattress so that the spine of the reclining body is in the preferred straight position. A further object is to provide a foundation unit in which the degree of center firmness may be changed as desired by manipulation of one or more variables of the materials of construction without redesigning the unit or altering the method of manufacture.

SUMMARY OF THE INVENTION

The foregoing and other objects are realized in accordance with the invention by a foundation unit with a border area formed of torsion springs supported upon a suitable frame and a center region formed of a plurality of cross rails and cushioning elements overlying the cross rails, wherein the rails and cushioning elements are disposed substantially immediately underlying the upper surface of the foundation unit. The cross rails extend transversely of the unit and are supported at their ends either by platforms positioned on the sides of the frame or by legs which extend from the cross rails down and are secured to the sides of the frame.

The cross rails themselves may be of a rigid material and are formed, or are secured, to the unit in such manner that they provide a limited degree of flexibility to absorb high impact or unusual loads. Preferably, these cross rails have a U-shaped cross section and upward arch, such as the cross rail design disclosed in U.S. Pat. No. 3,755,833.

The cushioning elements are supported by the individual cross rails and are disposed at least on the upper surface of the rails. One preferred form of cushioning element is a foam housing which is disposed on a cross rail so that it covers the upper surface and at least a portion of the sides of the rail. Such a housing can merely be placed upon the cross rails or be secured by adhesives or other means. Another preferred form of cushioning element is a sinuous wire spring which is secured at its ends to the cross rail so as to form an arch above the upper surface of the cross rails. Such wire springs extend along the length of the cross rail and a cross rail may be provided with one sinuous wire spring or a series of sinuous wire springs. Particularly when the cushioning elements are sinuous wire springs, the firmness of the center region may be varied by changing such variables as the number and degree of arching of the springs along the cross rail, or the pitch (number of turns per unit length) of the springs, or the gauge of the wire forming the springs.

When the cushioning elements are sinuous wire springs, these springs can be secured about the upper portion of their arches to an overlying wire grid which commonly is included in the upper surface of a foundation unit. Securing the wire springs in this manner would minimize sidesway of the springs, increasing stability of the foundation unit.

The invention and its objects, method of operation, features and advantages will be more fully understood by reference to the following drawings and detailed description.

DETAILED DESCRIPTION OF THE INVENTION

Figure 1:
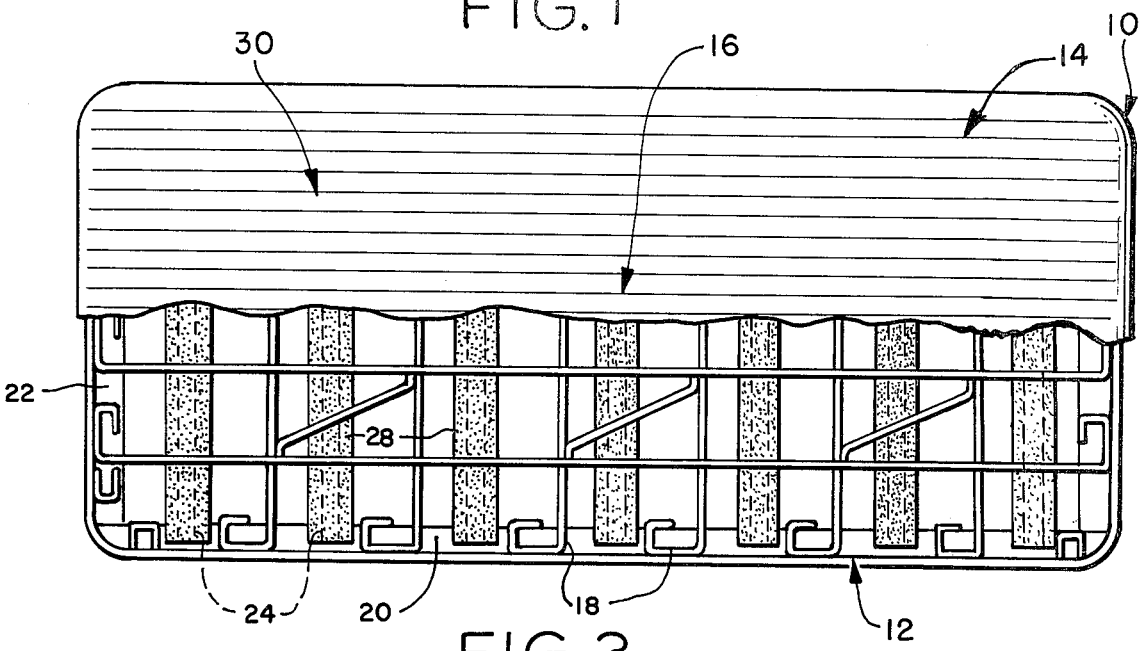
FIG. 1 is a partially cut-away top view of a foundation unit embodying features of the present invention.
Figure 3:
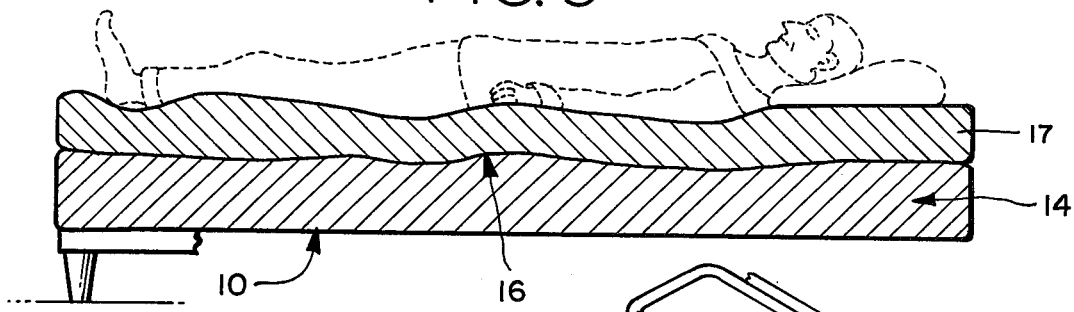
FIG. 3 is a diagrammatic side view of the foundation unit of FIG. 1 and an overlying mattress.
Figure 2:
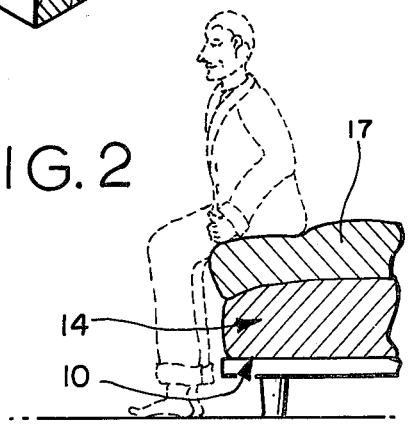
FIG. 2 is a diagrammatic end view of a portion of foundation unit of FIG. 1 and an overlying mattress.

Referring now to the drawings and particularly to FIGS. 1, 2 and 3, there is illustrated a foundation unit embodying features of the present invention indicated generally by reference numeral 10. The foundation unit 10 includes a substantially rectangular frame, designated generally by reference numeral 12, a resilient border region, designated generally by reference numeral 14, and a center region of greater firmness than the border region, designated generally by reference numeral 16. When a mattress 17 overlies the foundation unit 10, it is commonly subject to two types of loading, i.e., a concentrated weight loading from a person sitting at the edge of the mattress 17, as illustrated in FIG. 2, and a normal weight distribution loading from a person reclining on the mattress 17, as shown in FIG. 3. Under the concentrated weight loading above the border 14 of the foundation unit 10 from sitting at the edge of the mattress 17, the border 14 is sufficiently resilient to form a yieldable support. The overlying mattress 17 will not be subjected to crushing and damage caused thereby. When a person reclines upon the mattress 17, the body weight is distributed over a greater area of the mattress 17 and therefore the mattress does not require such a resilient supporting structure as provided at the border region 14. The center region 16 of the foundation unit 10 provides a sufficiently firm support for the mattress 17 while retaining resiliency that is active under normal load and weight distribution.

Figure 4:
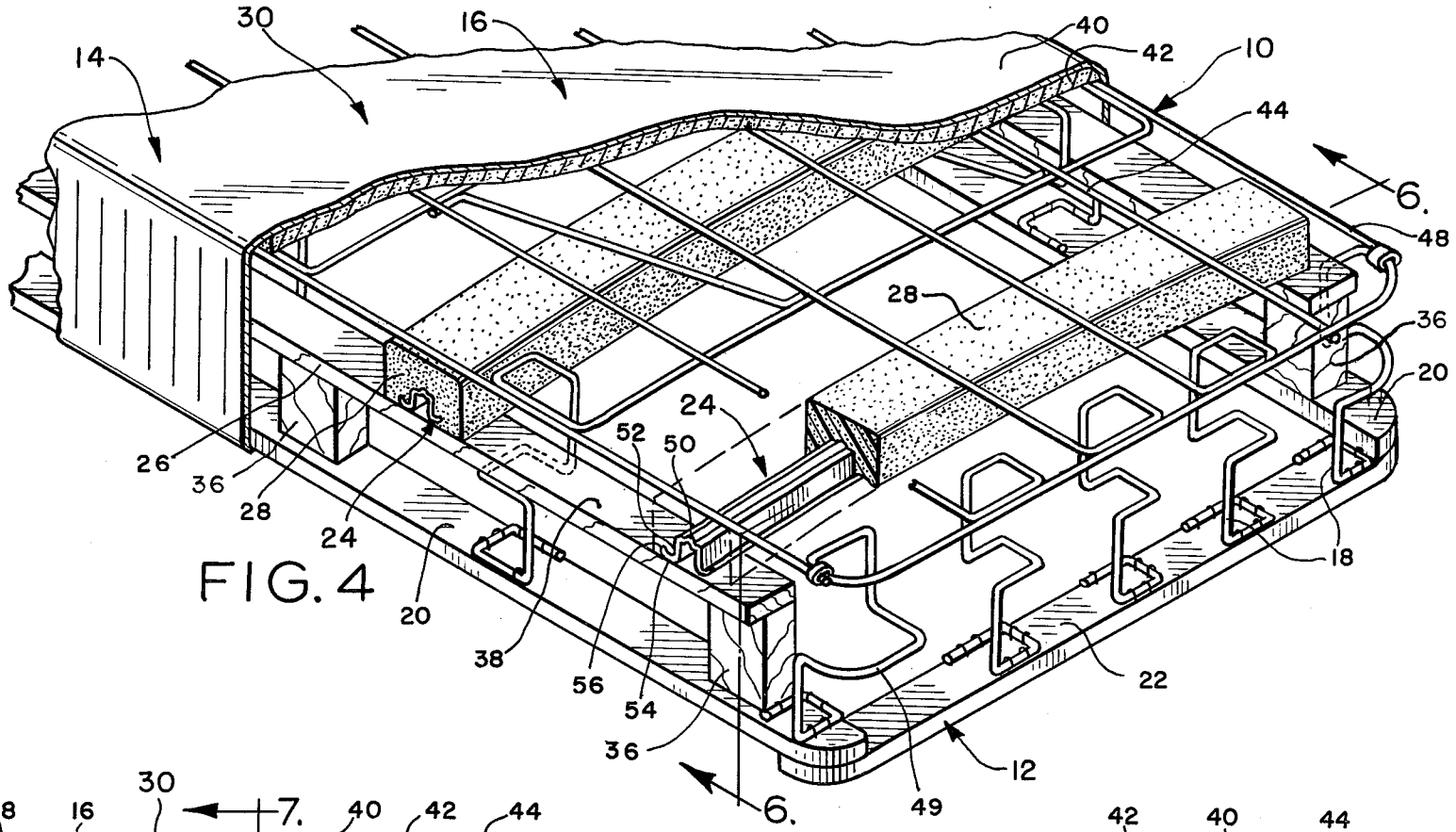
FIG. 4 is a partially cut-away perspective view of the foundation unit of FIG. 1.

Referring now to FIG. 4 also, the border region 14 includes an alignment of torsion springs 18 secured at their bottom ends to lower side members 20 and end members 22 of the frame 12. The center region 16 is formed of a plurality of cross rails 24 supported at their ends by platforms 26 which in turn are supported on the side members 20 of the frame 12. Overlying the upper surface of the cross rails 24 are cushioning elements in the form of foam housings 28 which overlie the top and at least a portion of the side surfaces of the cross rails 24. The foam housings 28 immediately underlie the top surface of the unit 10, which top surface is designated generally by reference numeral 30. The peripheral torsion springs 18 prevent damage and wear to the edge of an overlying mattress 17 when subjected to heavy and concentrated loads. The center region 16, with the cross rails 24 cushioned with the foam housings 28, is firmer than the border region 14 yet contributes to the comfortable reclining surface of an overlying mattress 17.

The frame 12 is normally formed of wood and its side members 20 support both the peripheral torsion springs 18 and the platforms 26. These platforms 26, which support the cross rails 24 at their ends, may each include lower pedestal members 36 and an overlying supporting slat 38 upon which the ends of the cross rails 24 rest. The peripheral torsion springs 14 are formed with such curvature that they circumvent the platform 26, being disposed in part below and in part above slat 38. The platforms 26 therefore do not retard the action of the torsion springs 14 although they are positioned in the same border region 14 of the unit 10.

Figure 5:
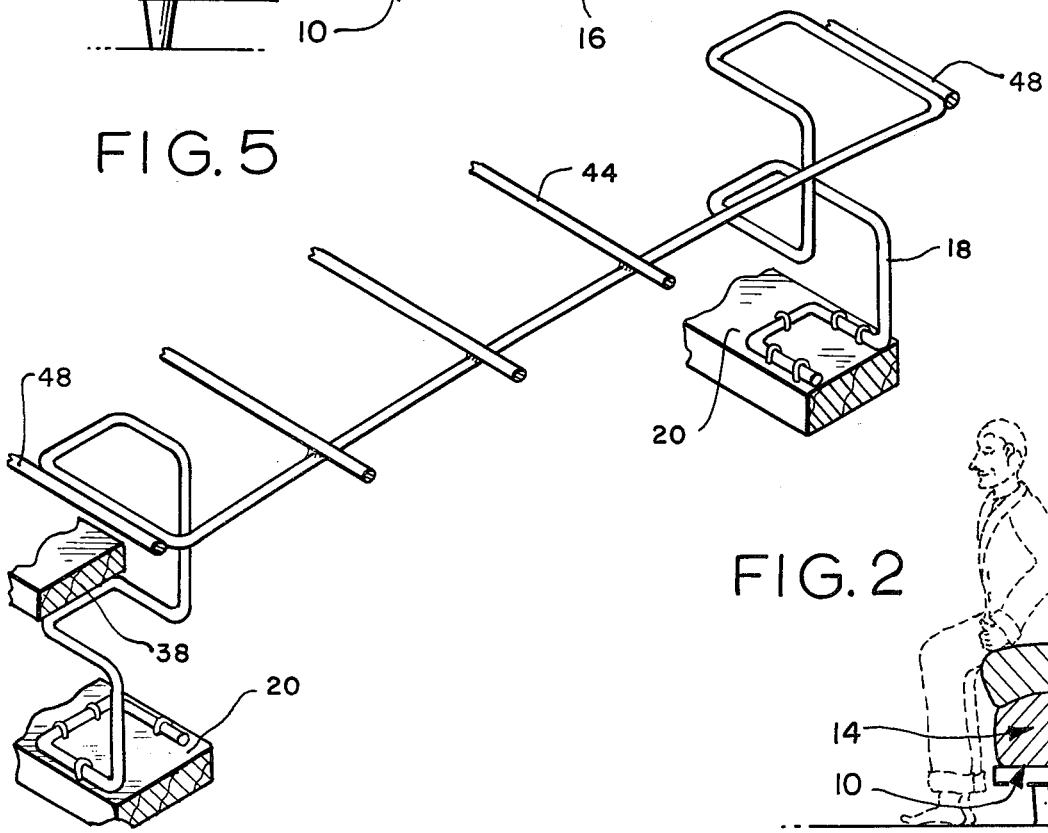
FIG. 5 is a partially cut-away closeup view of a portion of the foundation unit of FIG. 1.

The top surface 30 of the foundation unit 10, as illustrated, is a conventional surface with an outermost layer of decorative material 40 which extends down the sides of the unit 10 and is secured underneath the unit 10 to the side and end members 20, 22 of the frame 12 by conventional means, such as staples. Below the decorative layer 40 is a thin layer of insulating padding material 42 which provides tensile strength to the upper surface 30 and also provides some cushioning, particularly for the peripheral torsion springs 18. Below the padding layer 42 is a conventional wire grid 44 which may be formed as extensions of the torsion springs 18. A border wire 48 on the drawings extends about the periphery of the grid 44 and this border wire 48 may be formed in part as an extension of the corner torsion springs 49, as best illustrated in FIG. 5. The unit 10 may also include strips of noise insulating material (not shown) which are wound about the torsion springs 18. The torsion springs 18 of course may be secured to the side and end frame members 20, 22 by any conventional means such as staples and/or clips.

The cross rails 24 of the center region 16 extend from one platform 26 to the other, transversely of the unit 10, and are positioned adjacent to the upper surface 30 of the unit 10. The cross rails 24 are cushioned at least along their upper surface by cushioning elements such as the foam housings 28 illustrated. The foam housings 28 preferably have an inverted U-shaped cross section of such dimensions that the upper surfaces of the cross rails 24 are protected by a relatively thick layer of foam and the sides of the cross rails 24 are encased in a less thick layer of foam. The foam housings 28 may merely be placed on the cross rails 24 and will not be dislodged from such position because any normal force applied to the unit 10 will compress the housings 28 in the vertical direction, creating a better frictional engagement of the housing 28 with the underlying cross rails 24. The foam housings 28 could, however, be secured to the cross rails 24 in any conventional manner, such as by adhesives or tie members, and the selection of a suitable securing means is within the ordinary skill of one in the art. When the housings 28 are secured to the cross rails 24 with such additional conventional means, the housings 28 may only cover the top surface of the cross rails 24.

Figure 7:
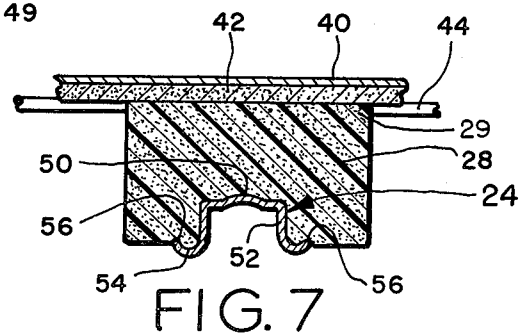
FIG. 7 is a cross-sectional view of the cross rail of the foundation unit of FIG. 1 taken along line 7—7 of FIG. 6.
Figure 6:
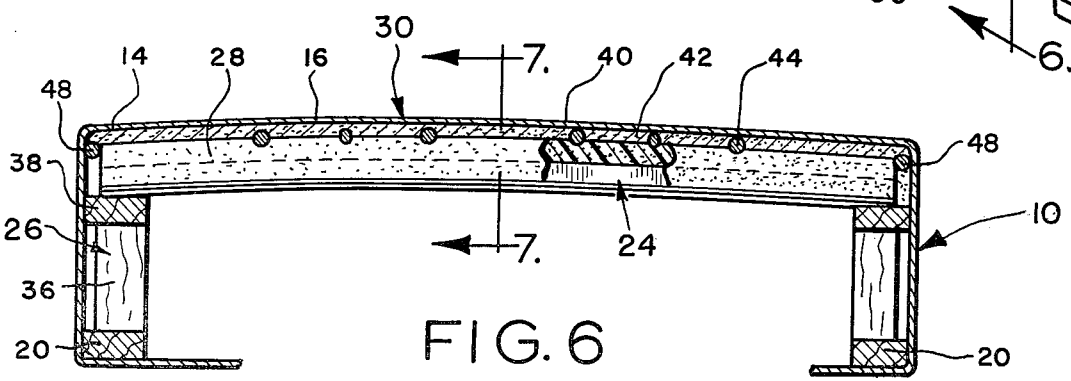
FIG. 6 is a cross-sectional side view of the foundation unit of FIG. 1 taken along line 6—6 of FIG. 4.

Referring now to FIGS. 6 and 7 also, the foam housings 28 preferably are of such dimensions and compressibility that they can be depressed in the range of about 1 to 2 inches. In this manner, the foam housings 28 provide sufficient resiliency to absorb pressure and normal impacts upon an overlying mattress 32. The foam housings 28 themselves are preferably 1 to 2 inches high and are compressible to a negligible height, i.e., about ⅛ inch, at which point further loading is born by the underlying cross rails 24. The degree of flexibility provided by the foam housings 28 can easily be varied as desired by changing the depth and/or compressibility of their cushioning layer. The cross rails 24 are substantially rigid and unyielding under normal use and weight distribution such as that caused by a reclining body. The foam housings 28 may also have an upper wear surface 29 such as a layer of spun bonded polypropylene which reduces surface wear of the housings 28.

The preferred cross rails 24 do have a limited degree of flexibility and will yield to absorb impact caused by unusual loading or high impact to the overlying mattress 32 and/or to the foundation unit 10 itself. In the preferred embodiment, the cross rails 24 are formed so as to have a generally inverted U-shape cross section as best seen in FIG. 7. The cross rail 24 has a top base section 50 and horizontally spaced depending leg sections 52, each of which terminates at its lower end in an outwardly extending generally horizontal flange 54 which has an upturned end section 56. Moreover, the preferred cross rails 24 are upwardly pre-stressed between its ends. The cross rail 24 as is more fully described in U.S. Pat. No. 3,755,833 wherein it is used to support torsion springs, is substantially rigid under normal use and yet will flex to a limited degree when the foundation unit 10 is subjected to unusual or high impact loads. The use of such cross rails 24 prevents damage to an overlying mattress and also prevents damage to the cushioning elements of whatever form disposed above the cross rails 24.

Figure 8:
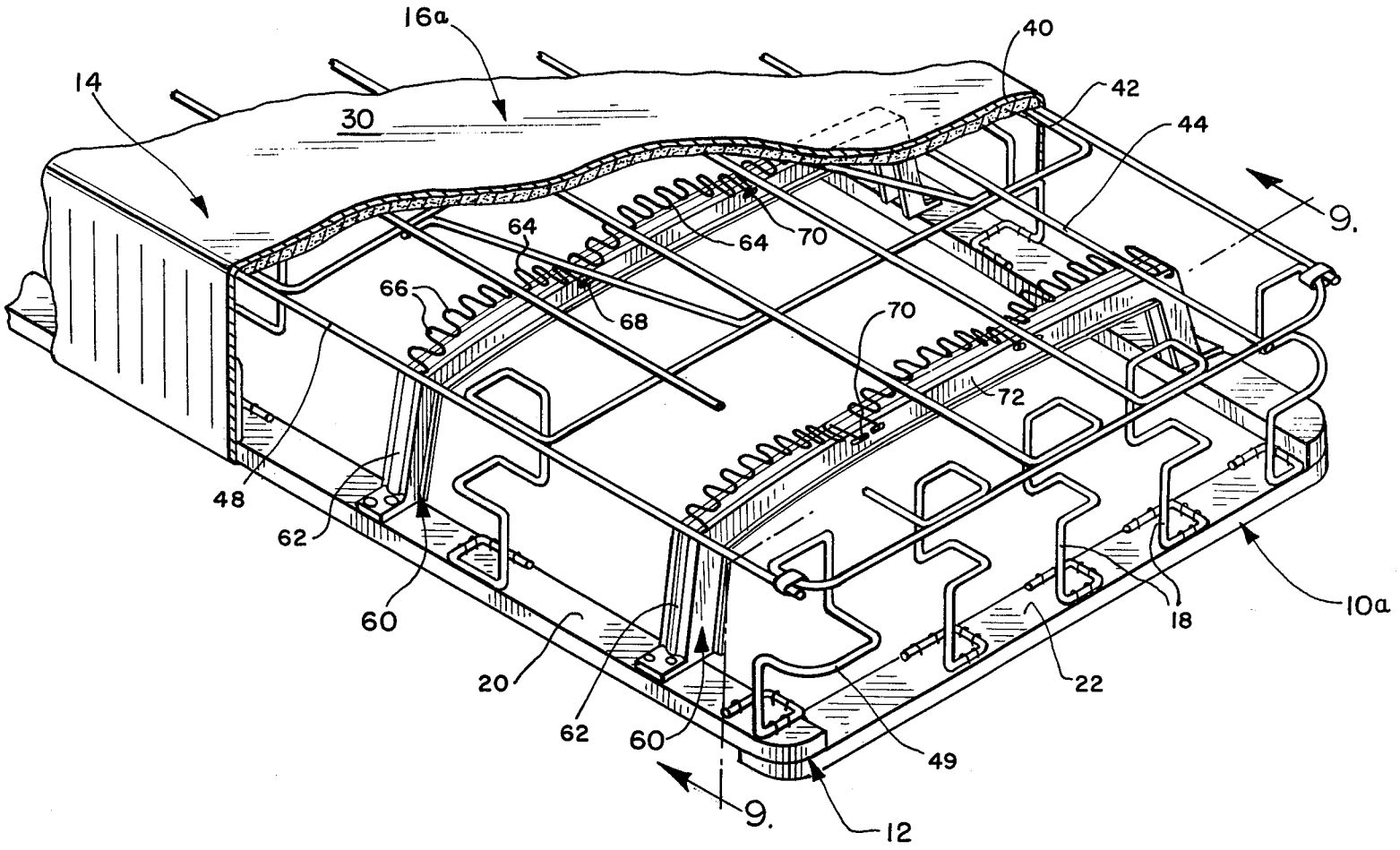
FIG. 8 is a partially cut-away perspective view of a portion of a foundation unit having features of the present invention.

Referring now to FIG. 8 there are illustrated another embodiment of the present invention. In this embodiment foundation unit **10*a* with a center region 16*a* including cross rails, designated generally by reference numeral 60. (Features of foundation unit 10*a* which are the same as illustrated for foundation unit 10 will be designated by the reference numerals). The cross rails 16*a* are formed with downwardly and outwardly extending ends legs 62 which are secured directly to the side members 20 of the frame 12. The legs 62 can be secured to the side members 20 by any conventional means such as staples or bolts or other apparatus well known to those or ordinary skill in the art. The cross rails 60 are illustrated cushioned about their upper surface by sinuous wire springs 64 which extend along the length of the cross rails 50. It is to be understood that cross rails 24 supported by platforms 26 as in the embodiment previously discussed and illustrated in FIGS. 1 to 7 can be used with cushioning elements formed as foam housings 28 or as sinuous wire springs 64 and the same applies to cross rails 60 with end leg members 62. The particular combination of elements shown in the drawings such as FIGS. 1 and 8**, is for illustration purposes only and the elements can be combined as desired.

Figure 9:
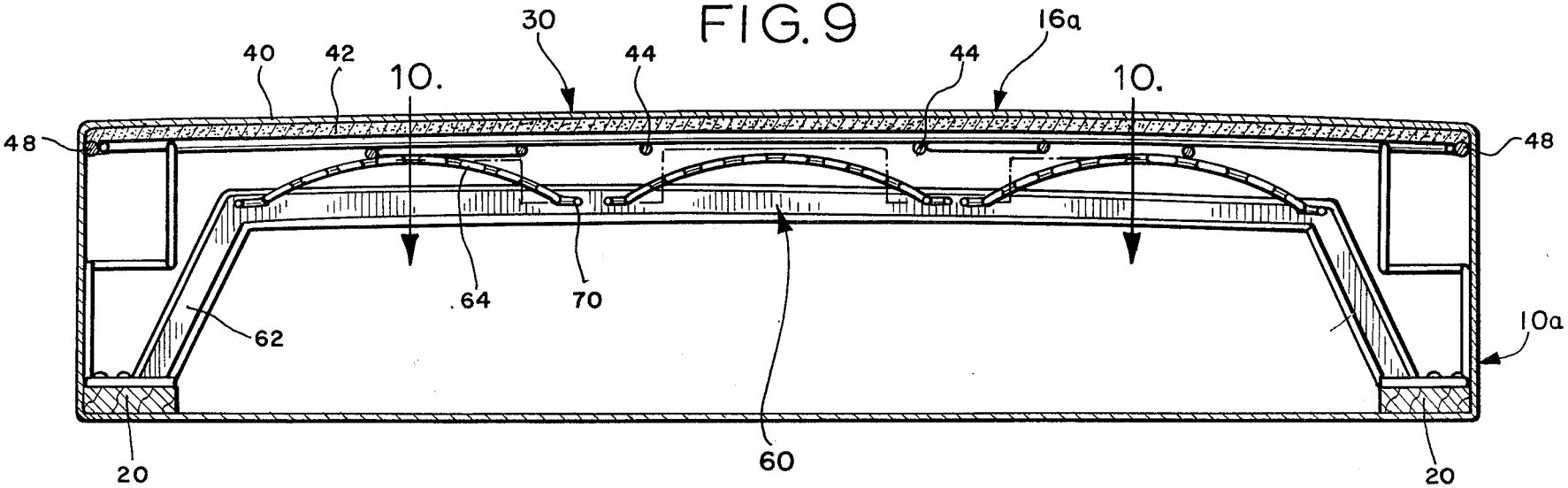
FIG. 9 is a cross-sectional side view of the foundation unit taken along line 9—9 of FIG. 8.
Figure 10:
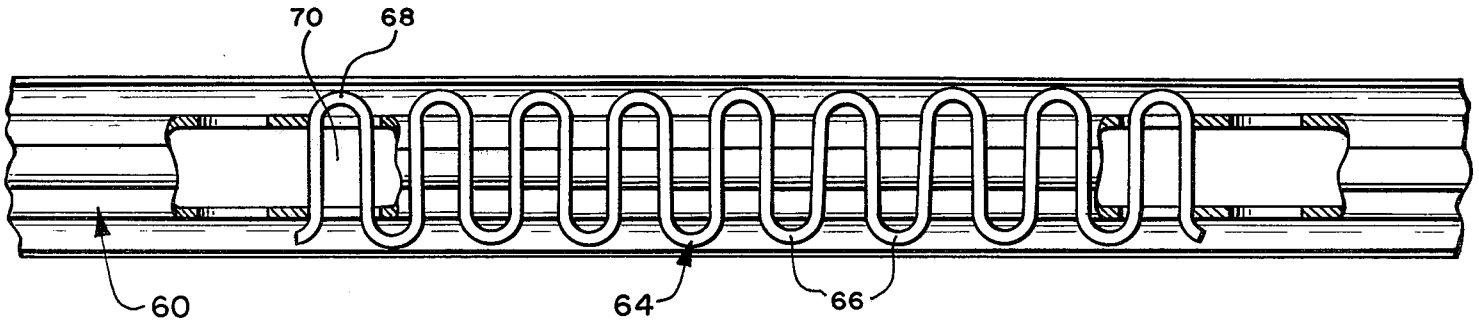
FIG. 10 is a cut-away enlarged top view of a cross rail of the foundation unit of FIG. 8 taken along line 10—10 of FIG. 9.

Referring now to FIGS. 9 and 10 also, the sinuous wire springs 64 are formed of a series of turns 66 and are secured at their end turns 68 to the cross rails 60 so that the springs 64 are arched upwardly. The cross rails 60 may include a plurality of slots 70 through which the end turns 68 of the springs 64 are inserted. The slots 70 each extend longitudinally of the rail 60 between the upper and lower ends of its side leg sections 72. Since the springs 64, positioned in an arched configuration, are stressed, no additional means for preventing the end turns 68 from dislodgement from the slots 70 is necessary. If desired, however the end turns 68 can be further secured to cross rails 60 by means of a bolt or clips which prevent the end turns 68 from sliding out of the slots 70 into which they were inserted. Other methods of securing the sinuous wire springs 64 to the cross rail 60 can be envisioned and selection of an appropriate means is within the ordinary skill of one in the art. The illustrated means, including slots 70 on the cross rails 60, is however a preferred means because of the ease of assembly and the latitude allowed during assembly regarding the length of the wire springs 64 being secured and the degree of arching of the springs 64.

Each cross rail 60 as illustrated is provided with several sinuous wire springs 64 positioned substantially end to end along the length of each cross rail 60. A cross rail 60 may be provided however with a single sinuous wire spring 64 extending along its length or with a greater plurality of wire springs 64, as desired. In any embodiment of the invention where sinuous wire springs 64 are used as the cushioning elements, the degree of firmness of the foundation unit **10*a* will be dependent upon a number of variables that can be manipulated to produce the desired firmness. For instance, as the pitch (number of turns 66 per unit length) is increased, firmness is also increased as would also be the case as the gauge of the wire utilized is increased. For any given sinuous wire spring 64, the degree of arching resultant from the positioning of its end turn 68 will also affect the resultant firmness of the unit 10, i.e., the greater the arching, the greater the firmness. In addition, the length of the span of a given sinuous wire spring 64 is inversely related to the resultant firmness of the unit 10*a*. As can be clearly seen, with cross rails 60 having slots 70 or a plurality of other convenient means for securing sinuous wire springs 64 along the length of the cross rails 60, selection of the desired sinuous wire springs 64 with respect to the gauge of the wire utilized, the pitch and length of the spring 64, varys the resultant firmness of the unit 10*a*. Moreover, with any single type of spring 64, one can also, by changing its span and degree of arching (dependent upon to which slots 70 the end turns 68 are secured), vary the firmness. The numerous options available to one assembling the unit do not require changing in any significant manner the method of assembly of the unit 10***a* and therefore allows custom manufacture of speciality foundation unit 10*a* at a significantly lower commercial cost than would otherwise be envisioned for manufacturing a line of foundation units 10*a* with differing degrees of firmness.

In a further preferred embodiment of the invention, the sinuous wire springs 64 are secured about the upper portion of their arches to the conventional wire grid 44 of the upper surface 30 of the unit 10*a*. When the sinuous wire springs 64 are so secured, any tendency of these springs 64 to sway laterally will be retarded and the unit 10*a* will have increased stability.

A foundation unit 10*a* with sinuous wire springs 64 as the cushioning elements will also provide a center region 16*a* which is firmer than if it were composed of torsion springs and yet is sufficiently resilient to absorb pressure of the overlying mattress 17 under conditions of normal use, as was described above for the foam housings 28. The cross rails 60 are rigid members, unyielding under normal use and yet preferably are formed so as to yield to a limited degree under extreme or unusual pressures to an overlying mattress 32 or to the foundation unit 10*a* itself.

A cross rail such as 60 preferably would have a similar cross section and similar upward stress between its end legs 62 to provide such limited degree of flex as described above the cross rails 24. Moreover, a limited degree of flex could also be provided to a cross rail such as 60 by securing its end legs 62 to the side members 20 of the frame 12 so that the legs 62 would spread upon unusual loading or high impact blows.

The above described particular embodiments of the invention, methods of operation, materials utilized, and combinations of elements can be varied without changing the spirit of the invention, as particularly defined in the following claims.

I claim:

1. A foundation unit having an upper surface for supporting a mattress or the like comprising:

a substantially rectangular frame;

a resilient border region; and a center region including a plurality of cross rails extending transversely of the unit, means for cushioning a plurality of said cross rails, said cushioning means overlying the upper surface of said cross rails, and means for supporting said cross rails so that said cushioning means substantially immediately underlies said upper surface of the unit, wherein the cushioning means has sufficient resiliency to allow the center region to be resiliently functional when subject to normal loads and the unit does not have any member overlying said cushioning means of sufficient rigidity and dimensions to substantially obstruct said functional resiliency of the center region.

2. The foundation unit of claim 1 wherein said resilient border region includes an alignment of torsion springs positioned adjacent to the perimeter of the unit.

3. The foundation unit of claim 2 wherein said rectangular frame includes lower side and end members and said torsion springs are supported on said lower side and end members.

4. The foundation unit of claim 3 wherein said support means for said cross rails includes a first and second platform supported on said lower side members of said rectangular frame, which platforms support said cross rails at their ends.

5. The foundation unit of claim 3 wherein said cross rails are formed with legs extending downwardly and outwardly from said cross rails and said legs are secured at their bottom ends to the lower side members of said rectangular frame and thereby support said cross rails.

6. A foundation unit having an upper surface for supporting a mattress or the like comprising:

a substantially rectangular frame;

a resilient border region; and a center region including a plurality of cross rails extending transversely of the unit, at least one foam housing for cushioning at least one of said cross rails mounted on the upper surface of said cross rail, said foam housing being at least one inch high and compressible to a substantially negligible height; and means for supporting said cross rails so that at least a portion of said foam housing substantially immediately underlies said upper surface of said surface, wherein the foam housing has sufficient resiliency to allow the center region to be resiliently functional when subject to normal loads.

7. The foundation unit of claim 6 wherein said cross rails have a limited degree of flexibility to absorb high impact loads.

8. The foundation unit of claim 6 wherein said foam housings cover at least the top surface of said cross rails.

9. The foundation unit of claim 8 wherein said foam housings are from about 1 to about 2 inches high and compressible to about one-eighth of an inch.

10. The foundation unit of claim 8 wherein said foam housings have an inverted U-shaped cross section and encase the upper and side surfaces of said cross rails.

11. A foundation unit having an upper surface for supporting a mattress or the like comprising:

a substantially rectangular frame;

a resilient border region; and a center region including a plurality of cross rails extending transversely of the unit and at least one sinuous wire spring, extending longitudinally along said cross rail and having its opposite ends secured to said cross rail, whereby said sinuous wire spring is arched upwardly above said cross rail to cushion the upper surface of said cross rail; and means for supporting said cross rails so that at least a portion of said cushioning sinuous wire spring substantially immediately underlies said upper surface of the unit, wherein said sinuous wire spring is sufficiently resilient to allow the center region to be resiliently functional when subject to normal loads.

12. The foundation unit of claim 11 wherein said cross rails have a limited degree of flexibility to absorb high impact loads.

13. The foundation unit of claim 11 wherein a plurality of said cross rails each have a plurality of means for securing the ends of said sinuous wire springs whereby the span and degree of arching of said sinuous wire springs are adjustable.

14. The foundation unit of claim 13 wherein said securing means are slots within said cross rails, which slots can receive at least the end turns of said sinuous wire springs.

15. The foundation unit of claim 11 wherein at least one cross rail supports more than one sinuous wire spring which springs are disposed in end to end relationship longitudinally along said cross rail.

16. The foundation unit of claim 11 wherein said upper surface of said unit includes a wire grid, and at least one sinuous wire spring is secured about the upper portions of its arch to said wire grid whereby lateral sway of said sinuous wire spring is substantially retarded.

* * * * *

UNITED STATES PATENT AND TRADEMARK OFFICE

CERTIFICATE OF CORRECTION

PATENT NO. : 4,129,908
DATED : December 19, 1978
INVENTOR(S) : ROBERT F. WAGNER

It is certified that error appears in the above-identified patent and that said Letters Patent are hereby corrected as shown below:

In the Specification:

Column 5, line 31, cancel "born" and insert -- borne --.

Column 6, line 2, cancel "ends" and insert -- end --.

Column 6, line 6, cancel "or" and insert -- of --.

Column 7, line 6, cancel "speciality" and insert -- specialty --.

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*